US006119646A

United States Patent [19]

Brogdon et al.

[11] Patent Number: 6,119,646

[45] Date of Patent: Sep. 19, 2000

[54] GUIDE FOR A MOVABLE MEMBER

[75] Inventors: James William Brogdon, Northville; David Keith Gill, Novi, both of Mich.

[73] Assignee: Teledyne Technologies Incorporated, Los Angeles, Calif.

[21] Appl. No.: 09/123,992

[22] Filed: Jul. 28, 1998

[51] Int. Cl.[7] ..... F02N 3/00

[52] U.S. Cl. ..... 123/188.9; 123/41.85

[58] Field of Search ..... 123/188.9, 41.01, 123/41.85; 137/338

[56] References Cited

U.S. PATENT DOCUMENTS

| | | | |
|---|---|---|---|
| 1,294,417 | 2/1919 | Dady . | |
| 1,748,518 | 2/1930 | Midgley . | |
| 4,967,780 | 11/1990 | Minami | 137/60 |

OTHER PUBLICATIONS

Cross–sectional drawing of valve guide used in Teledyne Continental engine Models TSIOL55A, B, and C, first produced in 1988.

*Primary Examiner*—Tony M. Argenbright
*Assistant Examiner*—Hai Huynh
*Attorney, Agent, or Firm*—Patrick J. Viccaro

[57] ABSTRACT

A guide for supporting sliding movement of a movable member includes a guide body having an outer surface, a first portion defining a first end of the guide body, and a second portion defining a second end of the guide body. A void is provided between the first and second ends and is defined by an inner surface of the guide body. A plurality of cooling projections project from the outer surface of the first portion, and a flange for stabilizing the guide projects radially from the guide body and defines a boundary between the guide's first and second portions. The guide may be adapted as, for example, a valve guide for use in an internal combustion engine for guiding the reciprocating sliding movement of a valve stem.

20 Claims, 6 Drawing Sheets

GUIDE FOR A MOVABLE MEMBER

The present invention relates to elements for supporting and guiding the sliding movement of a slidingly movable member. The present invention may be employed in applications wherein it is desirable to guide or otherwise support the sliding movement of a slidingly movable member.

BACKGROUND OF THE INVENTION

Piston driven internal combustion engines typically include valve guides for guiding and supporting the reciprocating sliding motion of each of the poppet valves that may be included in the cylinder head. Such poppet valves may include, for example, intake and exhaust valves. Poppet valve guides of a conventional (i.e. known) construction are shown in FIG. 1 installed in a cylinder head and are generally indicated as 1. Each valve guide 1 includes a mounting portion 2 that is press fit into the cylinder head. The valve guides 1 also include a portion 3 that protrudes from the cylinder head. A poppet valve stem (not shown) is inserted through the void 4 in the valve guide 1, and the inner surface of the valve guide 1 supports the valve stem as it slidingly reciprocates. A steel washer, such as washer 5, may be installed about the guide 1 in engines including an aluminum cylinder head in order to provide a seat for the valve spring and prevent the spring from abrading the cylinder head.

It is desirable that the poppet valve slidingly reciprocate along a straight path, and any lateral movement of the valve stem should be minimized so as to ensure proper closure of the valve and prevent premature wear or failure of the valve stem. To inhibit such lateral movement, conventional poppet valve guides, such as valve guide 1, include a long mounting portion, such as portion 2, that typically has a length that is 3 to 4 times the diameter of the cross-section of the valve guide's valve stem-receiving void, such as void 4. The long mounting portion inhibits lateral movement of the valve stem by providing support against the bending loads imparted to the valve guide by the poppet valve itself and also by the valve actuating apparatus. The long mounting portion of conventional poppet valve guides also serves a second function by providing a large contact area between the valve guide and the cylinder head to better facilitate the transfer of heat from the poppet valve to the valve guide and then into the cylinder head and its water jacket or cooling fins.

A large contact area between the valve guide mounting portion and the cylinder head requires the provision of a correspondingly thick cylinder head. Thus, a relatively thick cylinder head is necessary with conventional poppet valve guides (such as valve guide 1) in order to properly engage and suitably support the valve guide and provide the interface between the valve guide and the cylinder head necessary for suitable heat transfer to the cylinder head. However, increasing the thickness of the cylinder head increases the space occupied by the engine and the weight and cost of the engine.

Accordingly, there exists a need for an improved poppet valve guide for internal combustion engines. More broadly, there exists a need for an improved guide for supporting and directing the sliding movement of a slidingly movable member, such as, for example, a valve.

SUMMARY OF THE INVENTION

The present invention addresses the foregoing needs, among others, by providing an improved guide for supporting movement of a slidingly movable member. The guide includes a guide body having an outer surface, an inner surface, and first and second portions. The first portion of the guide includes a region that is the first end of the guide body, and the second portion includes a region that is a second end of the guide body. The present guide also includes a void between the first end and the second end, and the void is defined by the guide body's inner surface and has a longitudinal axis. The outer surface of the first portion includes a plurality of projections projecting outward from the outer surface, and a flange projects from the guide body and defines a boundary between the first and second portions.

One particular application of the guide is as a valve guide for a poppet valve such as, for example, an intake valve or an exhaust valve, of an internal combustion engine. As will be shown herein, when the present invention is adapted to that application, it may address the above-described deficiencies in the conventional poppet valve guides, among others. The movable member is received in the void of the present guide and may slidingly move within the void. Thus, for example, the void may have a circular cross-section when the movable member is an internal combustion engine poppet valve of a conventional design. However, the void also may have any other suitable cross-section or configuration so as to appropriately slidingly receive the movable member.

The projections from the first surface may be adapted as, for example, heat dissipating elements that will dissipate heat from the guide. Adapting the projections for that purpose will be particularly useful when the guide of the present invention is used as an internal combustion engine poppet valve guide, such as an exhaust valve guide, so as to dissipate the heat generated by the frictional interaction between the guide and the valve stem. Each projection from the first portion may be provided as a fin projecting radially from the outer surface of the first portion and encircling a region of the guide body. Each fin may be, for example, an annular-shaped (i.e., ring-shaped) fin having first and second surfaces and a circular perimeter, and each of the fins may be disposed within a plane that is generally perpendicular to the longitudinal axis of the void. In order to enhance the ability of the guide to dissipate heat, the fins may be spaced apart along the outer surface of the first portion by a distance that permits a fluid, such as, for example, engine oil, to circulate between the fins.

When the present invention is adapted for use as a poppet valve guide in an internal combustion engine, the fins may be contacted by the engine oil spray and other gases above the cylinder head, and heat is conducted to the oil and gases to cool the guide and the poppet valve. The enhanced cooling capability of the movable member guide of the present invention reduces the necessity for a large contact area between the guide and the cylinder head, allowing the guide to be more compact than known conventional guides, including poppet valve guide 1 above.

The present movable member guide's second portion may be a mounting portion that may be at least partially disposed within a structure to which the guide is mounted. In one possible design, the flange may be configured to have a circular perimeter, but may be configured as necessary to be suitably received by the structure to which the guide is mounted. When adapted for use as a poppet valve guide for an internal combustion engine, the second portion of the guide body may be a mounting portion that may be at least partially disposed in a bore within the cylinder head, and the flange contacts the cylinder head and supports the valve guide against the lateral movement urged by the bending forces that are imparted to the guide by the reciprocating valve itself and by the valve actuating apparatus. Also, when adapted for use as an internal combustion engine poppet valve guide, the flange's contact with the cylinder head provides additional heat dissipation and further reduces the necessity for a large contact area between the cylinder head and the second portion, allowing for compact size.

Considering the advantages obtained when the movable member guide of the present invention is adapted for use as an internal combustion engine poppet valve guide, it will be understood that the present invention also is directed to a valve guide for supporting a valve stem through the cylinder head of an internal combustion engine. The valve guide includes a valve guide body having outer and inner surfaces, a first portion including a first end of the valve guide body, and a second portion including a second end of the valve guide body and provided for mounting in a cylinder head. A valve stem-receiving void is provided between the first and second ends. The first portion includes a plurality of cooling projections projecting from the outer surface for dissipating heat from the valve guide. A support flange projects radially from the valve guide body, and is provided for supporting the guide and inhibiting its lateral movement relative to the cylinder head. Because of the enhanced stability and heat dissipation capabilities of a valve guide constructed according to the present invention, the necessary mounting member/cylinder head contact area may be reduced relative to the known, conventional poppet valve guide designs.

The present invention also is directed to a valve assembly comprising a valve including a valve stem, a valve guide constructed according to the present invention, and a coil spring having a base. The coil spring is disposed about the first portion of the valve guide's valve guide body so that the spring's base is supported by the valve guide's support flange. To inhibit wear of the valve guide, the valve assembly also may include one or more annular-shaped washers disposed on the support flange intermediate the support flange and the coil spring base. The valve assembly may further include a retainer that is secured to the valve stem and that includes an annular lip. The retainer contacts the coil spring and retains the coil spring about the valve stem intermediate the annular lip and the support flange.

The present invention is additionally directed to an apparatus, such as, for example, a piston driven internal combustion engine, that includes a cylinder head, at least one valve including a valve stem, and at least one valve guide constructed according to the present invention. Utilizing a valve guide constructed according to the present invention in, for example, an internal combustion engine reduces the necessary thickness of the cylinder head region in which the valve guide is mounted, thereby reducing engine size and weight.

The reader will appreciate the foregoing details and advantages of the present invention, as well as others, upon consideration of the following detailed description of embodiments of the invention. The reader also may comprehend such additional details and advantages of the present invention upon practicing the invention.

BRIEF DESCRIPTION OF THE DRAWINGS

The characteristics and advantages of the present invention may be better understood by reference to the accompanying drawings wherein like reference numerals are employed to designate like elements and in which.

DETAILED DESCRIPTION OF EMBODIMENTS OF THE INVENTION

Figure 1:
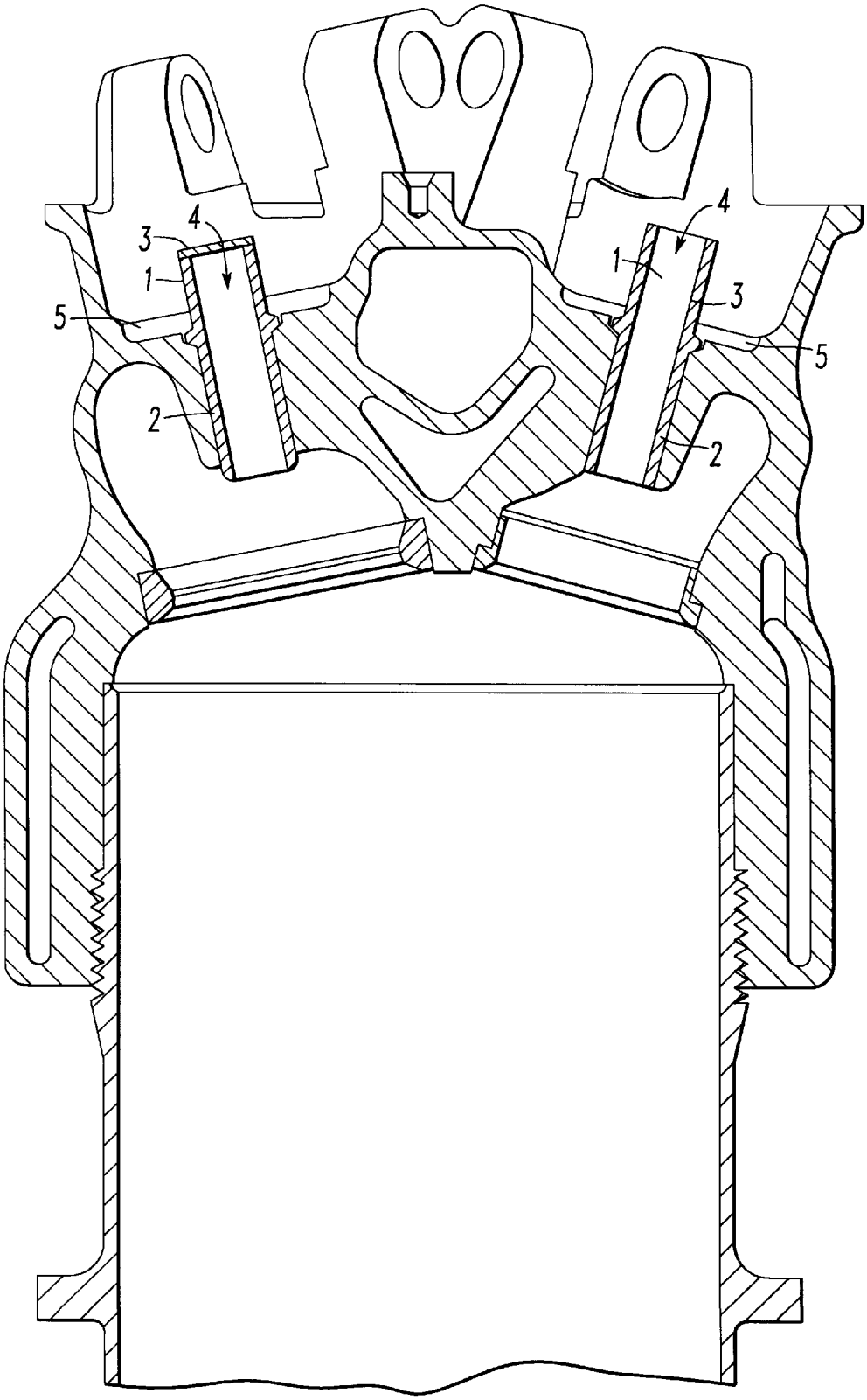
FIG. 1 is a cross-sectional view taken through a cylinder head and cylinder of a piston driven internal combustion engine, and wherein a conventional valve guide is shown installed in the cylinder head.

Referring now to the drawings, which are for the purpose of illustrating embodiments of the invention and not for the purpose of limiting the same, FIGS. 2–7 depict an embodiment of a movable member guide constructed according to the present invention and in the form of a valve guide 10 used to guide sliding movement of an internal combustion engine poppet valve. The valve guide 10 includes a valve guide body 12 having an outer surface 13, a first portion 14, and a second portion in the form of a mounting portion 16. The mounting portion 16 is generally cylindrical in shape and includes a beveled region 38 tapering toward the second end 22.

An annular-shaped support flange 18 extends radially outward from the valve guide body 12 and defines a boundary between the first portion 14 and the mounting portion 16. The support flange 18 includes a stepped portion 18' that reinforces the attachment of the support flange 18 to the valve guide body 12. The support flange 18 further includes first and second surfaces 19 and 19', respectively.

The valve guide 10 further includes a first end 20, defined by the first portion 14, and a second end 22, defined by the mounting portion 16. An elongate void 24 of generally circular cross-section, configured to receive the valve stem of a poppet valve, is defined by an inner surface 11 of the valve guide body 12 and connects the first end 20 and second end 22. Thus, the void 24 passes through the length of the valve guide body 12.

The first portion 14 of the valve guide 10 includes a plurality of annular projections in the form of cooling fins 26, which project radially outward from the valve guide body 12. Each cooling fin 26 includes two surfaces 28 and a circular perimeter 30. A space, such as, for example, spaces 32, is provided between adjacent cooling fins 26. The inner surface 11 of the void 24 within the first portion 14 includes an annular recess 36 in the vicinity of the first end 20.

The valve guide 10 may be constructed of a material such as, for example, aluminum bronze, which will resist wear upon repeated sliding frictional contact with a valve stem and which will also conduct heat into the cylinder head at the interface between the cylinder head and the guide 10. Other materials suitable as materials for the valve guide 10 of the present invention will be readily apparent to those in the combustion engine design arts and include materials conventionally used in the manufacture of poppet valve guides.

Figure 2:
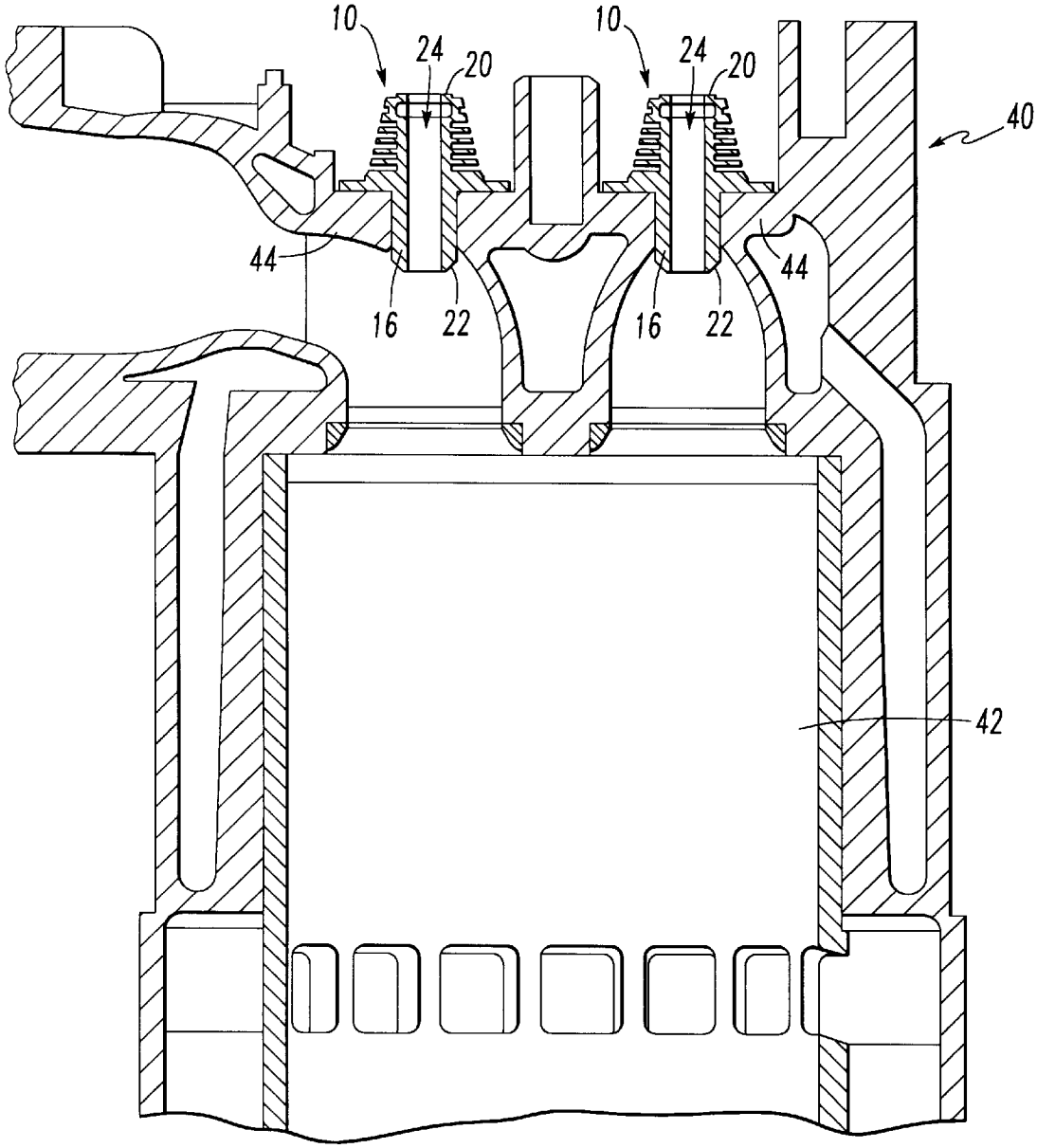
FIG. 2 is a cross-sectional view taken through a cylinder head and cylinder of a piston driven internal combustion engine, and wherein a movable member guide constructed according to the present invention and in the form of a poppet valve guide is shown in cross-section installed in the cylinder head.

The valve guide 10 may be installed in a cylinder head as shown in FIG. 2, which depicts a cross-section through the cylinder head 40 and a cylinder 42 of a piston driven internal combustion engine. Mounting portion 16 is press fit into a correspondingly-shaped bore in a region 44 of the cylinder head 40 so that the outer surface 13 of the mounting portion 16 is in contact with the cylinder head region 44 within the correspondingly-shaped bore, and so that the second surface 19' of the support flange 18 contacts the cylinder head region 44. Thus, the second end 22 is proximal to the cylinder 42 and the first end 20 is proximal to the valve actuating elements (not shown) above the cylinder head 40. On installation, beveled region 38 facilitates positioning the valve guide 10 within the bore in the cylinder head region 44.

Figure 3:
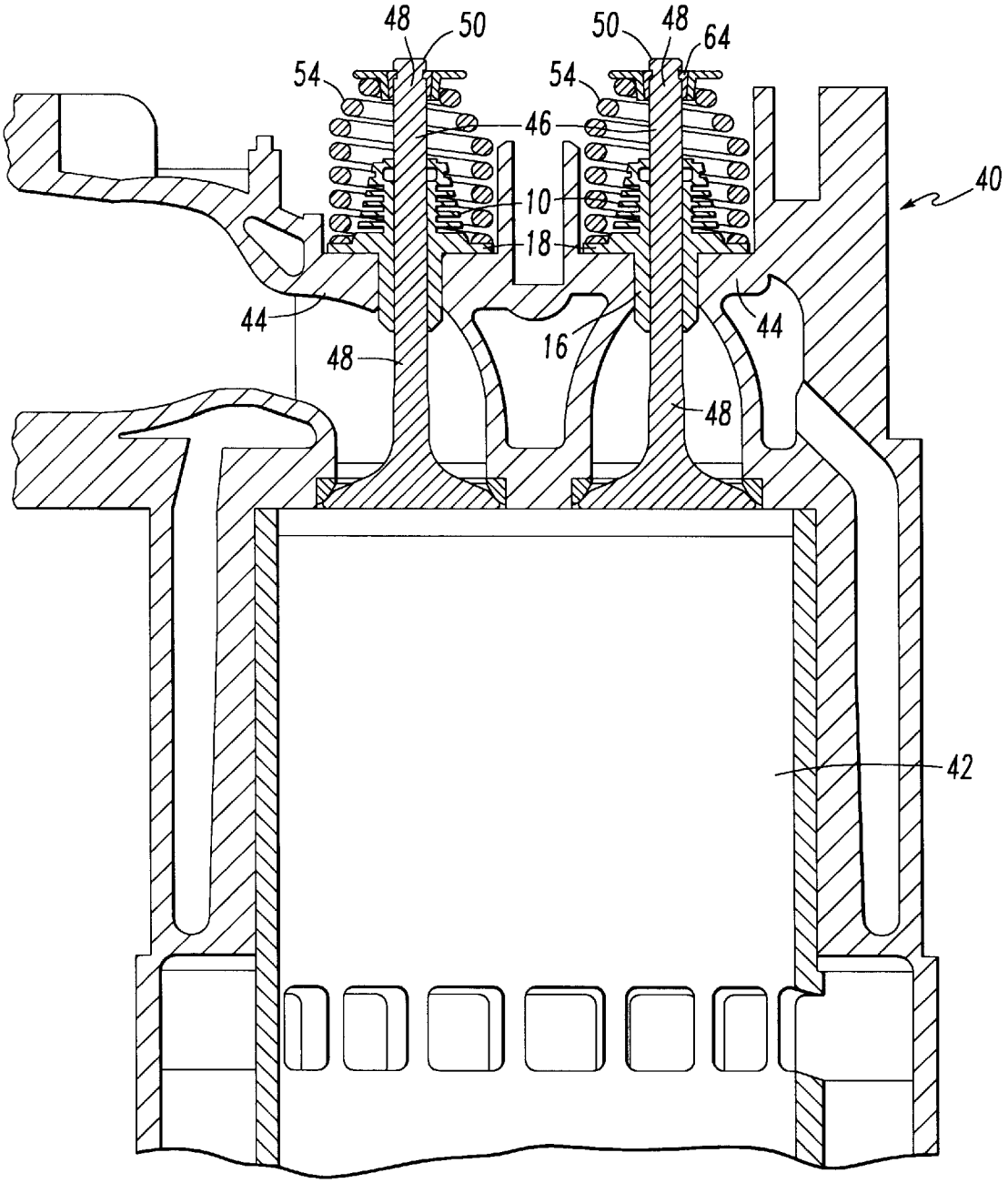
FIG. 3 is a cross-section taken through the cylinder head and cylinder depicted in FIG. 2 with the poppet valve guide depicted in FIG. 2 installed in the cylinder head, and further wherein a poppet valve and a valve spring are shown installed in the cylinder head.
Figure 4:
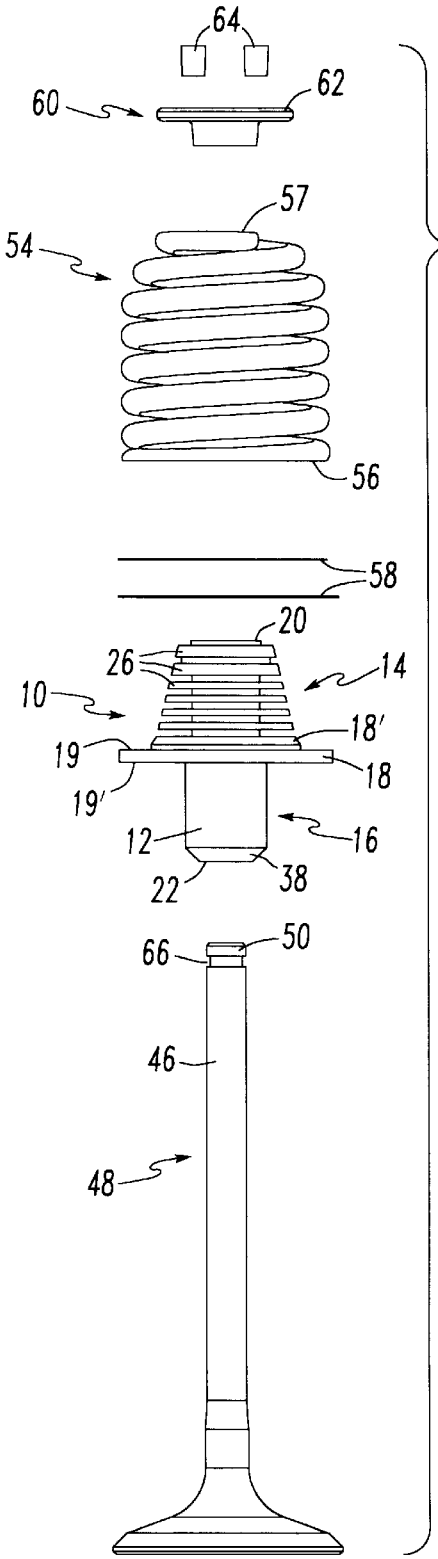
FIG. 4 is an assembly view indicating an arrangement by which the poppet valve guide depicted in FIGS. 2 and 3 may be associated with a poppet valve and a valve spring.

A poppet valve may be slidingly secured within the valve guide 10 as shown in FIG. 3. FIG. 4 depicts disassembled the several elements secured to the cylinder head 40 in FIG. 2. An o-ring seal (not shown) is disposed in the annular recess 36 of the void 24, and the valve stems 46 of poppet valves 48 are then each slidingly disposed within the void 24 of a valve guide 10 of the present invention so that valve stem end 50 protrudes from the first end 20 of the valve guide 10. The o-ring seal seals the area above the cylinder head 40 from the area in which waste gases are conducted on actuation of the poppet valve 48.

A valve spring in the form of a coil spring 54 having a base 56 and a crown 57 is disposed about the first end 20 of the guide 10. The base 56 of the coil spring 54 is supported by the second surface 19 of the support flange 18. In that arrangement, the valve stem 46, valve guide 10, and coil spring 54 are generally coaxial. At least one washer in the form of an annular-shaped metallic disk 58 contacts the first surface 19 of the support flange 18 and is interposed between the first surface 19 and the base 56 of the coil spring 54. The disk 58 may be of a material having enhanced wear resistance relative to the first surface 19 to thereby inhibit wear of the first surface 19.

Figure 9:
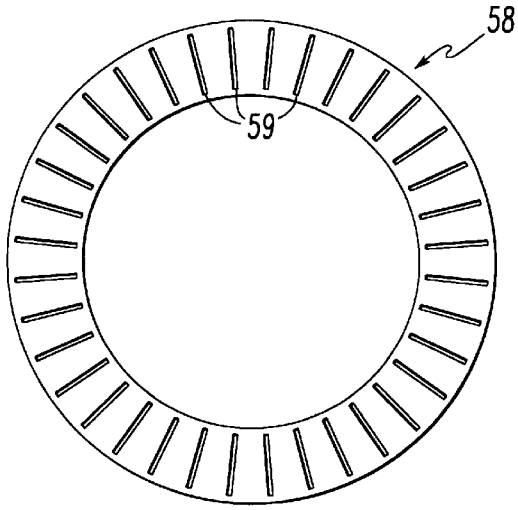
FIG. 9 is a view of a washer that may be interposed between a valve spring and the support flange of the poppet valve guide depicted in FIGS. 2–6, and showing a surface of the washer including ridges thereon.
Figure 5:
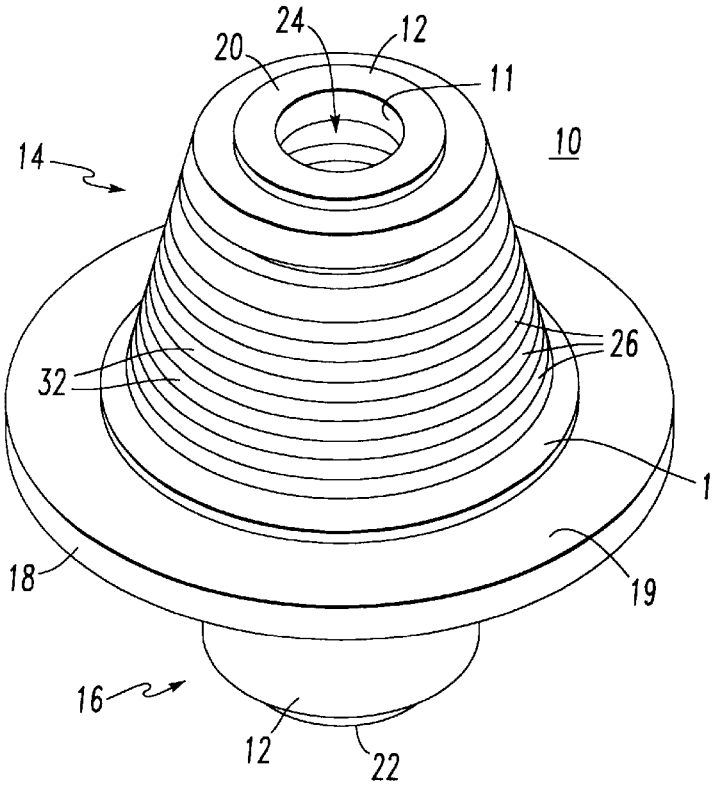
FIG. 5 is an isometric view taken from a first orientation of the poppet valve guide depicted in FIGS. 2–4, and generally showing the cooling fins and a surface of the support flange of the poppet valve guide.
Figure 6:
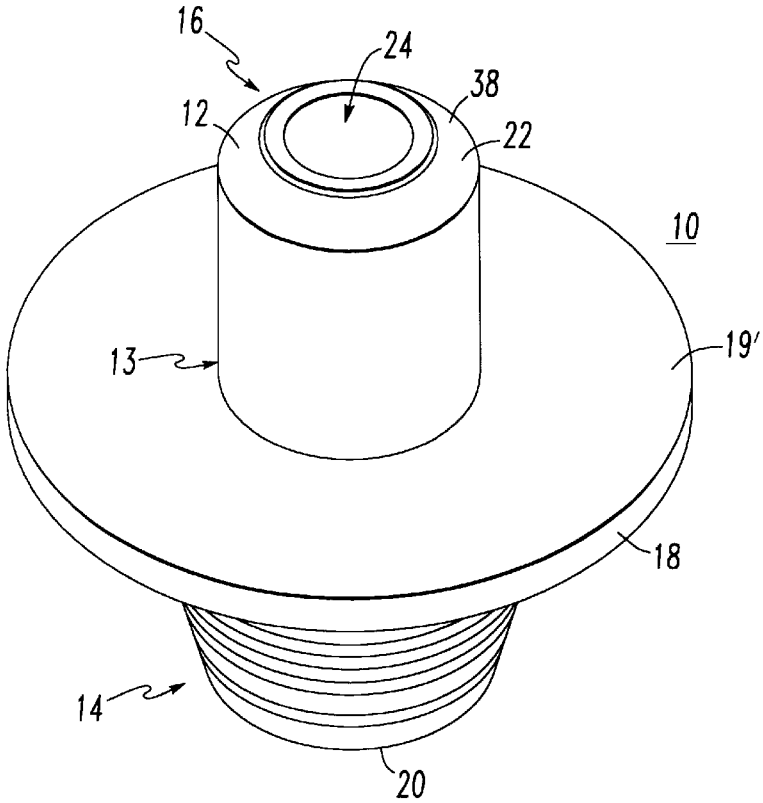
FIG. 6 is an isometric view taken from a second orientation of the poppet valve guide depicted in FIGS. 2–5, and generally showing the mounting portion and a surface of the support flange of the poppet valve guide.
Figure 7:
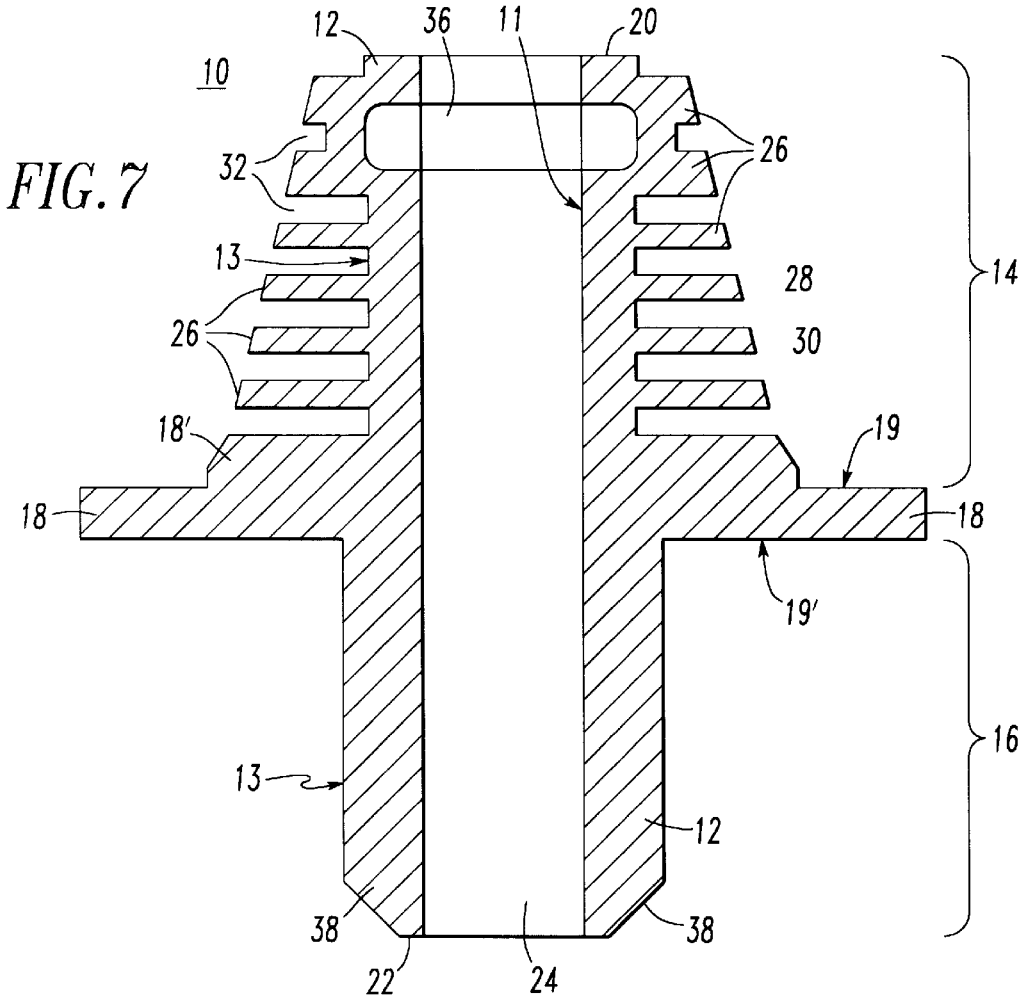
FIG. 7 is a sectional view of the poppet valve guide depicted in FIGS. 2–6 taken generally through a central axis of the void through the poppet valve guide.

As indicated in FIG. 4, in the present embodiment two disks 58 are interposed between the base 56 of the coil spring 54 and the first surface of the support flange 18. Each of the disks 58 includes two surfaces, one surface being planar and the reverse surface including ridges 59, as shown in FIG. 9. The ridges 59 of one disk 58 contact the first surface 19 of the support flange 18, the ridges 59 of the second disk 58 contact the base 56 of the coil spring 54, and the planar surfaces of the two disks 58 contact each other. The ridges 59 cause the two disks 58 to grip the coil spring base 56 and the surface 19 and, therefore, the disks 58 may experience relative rotation as their planar surfaces slide against one another. In this way, the coil spring 54 may rotate relative to the valve guide 10 as the coil spring 54 is repeatedly compressed, which urges the valve 48 to also rotate. Rotation of the valve 48 inhibits the valve 48 from sticking to the valve seat.

To retain the coil spring 54 about the valve stem 46, an annular-shaped retainer 60 having a central bore and an annular lip 62 may be disposed about the valve stem end 50 so that the lip 62 contacts the crown 57 of the coil spring. The retainer 60 is secured on the valve stem end 50 by press fitting two hemispherical valve cotters 64 into an annular groove 66 on the valve stem end 50. The press fit arrangement between the retainer 60, valve stem end 50, and valve cotters 64 is illustrated in the cross-sectional view of FIG. 8.

Once assembled as shown in FIG. 3 and as indicated in FIG. 4, the coil spring 54 biases the poppet valve 48 in a direction so that the pathway from cylinder 42 is closed. A suitable valve actuating apparatus applies a force to valve stem end 50 against the force of the coil spring 54 to actuate the valve 48. The valve guide 10 supports the valve stem 46 and directs it to reciprocate along a path generally coincident with the longitudinal axis of the void 24. The valve guide 10 also inhibits its lateral movement and, correspondingly, lateral movement of the valve stem 48 to better ensure suitable closure of the valve.

Figure 8:
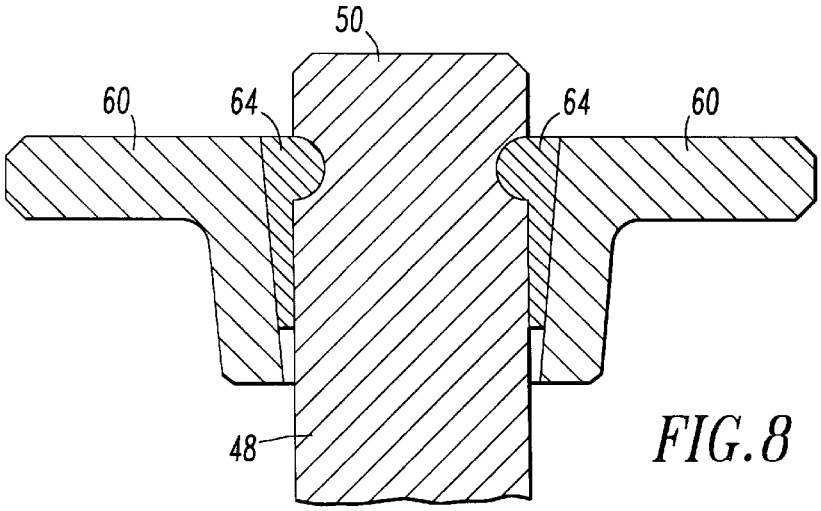
FIG. 8 is a sectional view through an end portion of a poppet valve stem and its associated retaining elements, taken generally through the central longitudinal axis of the valve stem and showing an arrangement for associating the poppet valve with a valve spring.

It will be understood that the foregoing discussion and the accompanying FIGS. 3, 4, and 8 illustrate only one possible arrangement for slidingly securing a poppet valve 48 within the valve guide 10 and retaining a coil spring 54 or other valve spring about the first portion 14 of the valve guide 10. It will be understood that alternate arrangements will be readily apparent to those having ordinary skill in the combustion engine design arts, and such alternate arrangements are encompassed within the scope of the present invention.

The design of valve guide 10 provides several advantages relative to known, conventional poppet valve guide designs such as, for example, conventional poppet valve guide 1 of FIG. 1. The mounting portion 16 of valve guide 10 may be significantly shorter in length than the mounting portion of conventional valve guides, while still providing sufficient structural support to the valve guide 10 against lateral movement and a sufficient path for heat transfer from the valve guide 10. (As used herein, the "length" of a mounting portion of a valve guide is that measured along the longitudinal axis of the valve stem-receiving void, such as void 24.) The length of the interface between the mounting portion 16 and the cylinder head of the valve guide 10 may be about 2 to about 3 times the diameter of the cross-section of the void 24 (taken perpendicular to the longitudinal axis of the void 24) and provide sufficient support against lateral movement and satisfactory heat transfer to the cylinder head. This compares with a necessary interface distance of 3 to 4 times the valve stem-receiving void cross-sectional diameter that typically is required of conventionally-designed poppet valve guides in order to impart suitable stability against lateral movement and satisfactory heat transfer to the cylinder head.

In order that the mounting portion/cylinder head interface length may be reduced in the present invention relative to conventional poppet valve guide designs, the valve guide 10 obtains significant lateral support from annular support flange 18, which in the embodiment has a diameter that is larger than the length of mounting portion 16 (approximately twice as large). Further structural support is obtained by adapting the support flange 18 to support the base 56 of the coil spring 54, and the force of the coil spring 54 urges the support flange 18 against the cylinder head.

Thus, the reduction in the necessary length of the mounting portion/cylinder head interface is in part provided for by the size of the support flange 18 at the entrance to the bore in the cylinder head, the second surface 19' of which is press fit tightly against the cylinder head on installation and is held in close contact therewith by the force of coil spring 54. The close contact of the second surface 19' of the support flange 18 also provides a heat transfer path from the valve, through the valve guide 10, and to the cylinder head. Further, the support flange 18 absorbs a substantial portion of the bending load imparted to the valve guide 10 by the poppet valve 48 and the valve actuating apparatus. The design of the present valve guide 10 may shorten the necessary length of engagement between the mounting portion 16 and the cylinder head by at least about 1 diameter (of the cross-section of the valve stem-receiving void), which reduces the necessary thickness of the cylinder head and provides for a significant space, cost, and weight savings for the engine.

The fact that the support flange 13 also operates as a support for the coil spring 54 eliminates the need for the steel washer commonly disposed underneath the valve spring in engines incorporating an aluminum cylinder head. That feature eliminates an additional component that also may increase the size of the engine.

The valve guide's cooling fins 26 allow for additional heat transfer by providing the guide 10 with a significantly greater surface area for transfer of heat from the valve guide 10 and the valve stem 46 to the gases and oil mist within the valve area of the engine. Spacing the cooling fins 26 apart by a distance that will enhance circulation of engine oil between the cooling fins 26 may further promote heat transfer to the oil. Additional heat transfer capability may be provided by arranging the cooling fins 26 so that the distance between the outer surface 13 of the valve guide body 12 increases as the position of the cooling fin 26 approaches the support flange 18. Thus, the cooling fins 26 and the interface between the support flange 18 and the cylinder head act together to cool the valve stem 46 and the guide 10 itself and provide for enhanced engine service life.

Thus, the valve guide 10 of the present invention provides improvements in overall compactness, lateral stability, and heat transfer capability compared with known, conventional poppet valve guides.

Although the foregoing description has necessarily presented a limited number of embodiments of the invention, those of ordinary skill in the relevant art will appreciate that various changes in the configurations, details, materials, and arrangement of the elements that have been herein described and illustrated in order to explain the nature of the invention may be made by those skilled in the art, and all such modifications will remain within the principle and scope of the invention as expressed herein in the appended claims. In addition, although the foregoing detailed description has been directed to an embodiment of the movable member guide of the invention in the form of a valve guide for poppet valves within an internal combustion engine, it will be understood that the present invention has broader applicability and, for example, may be used in connection with the support and guided movement of slidingly movable members in environments other than internal combustion engines. All such additional applications remain within the principle and scope of the invention as embodied in the appended claims.

We claim:

1. A valve guide for supporting a valve stem through the cylinder head of an internal combustion engine, the guide comprising:

a valve stem guide body having an outer surface and an inner surface, said valve stem guide body comprising a first portion defining a first end of the guide and a second portion defining a second end of the guide, said second portion to be mounted in the cylinder head;

a void between said first end and said second end having a circular cross-section, said void defined by said inner surface and having a longitudinal axis, said void receiving the valve stem;

a plurality of cooling projections projecting from said outer surface of said first portion; and a flange projecting from said guide body, said flange defining a boundary between said first portion and said second portion.

2. The valve guide of claim 1, wherein said second portion has a length that is about 2 to about 3 times a diameter of said circular cross-section.

3. The valve guide of claim 1, wherein each said cooling projection is a cooling fin projecting radially from said outer surface and encircling a region of said valve stem guide body.

4. The valve guide of claim 3, wherein each said cooling fin is an annular-shaped fin having a circular perimeter.

5. The valve guide of claim 4, wherein each said cooling fin projects radially outward from said outer surface within a plane that is generally perpendicular to said longitudinal axis.

6. The valve guide of claim 5, wherein said cooling fins are equally spaced apart along said outer surface of said first portion by a distance that permits engine oil to circulate between said cooling fins.

7. The valve guide of claim 6, wherein a distance between said outer surface and said circular perimeter of a said cooling fin increases as a position of said cooling fin is closer to said support flange.

8. The valve guide of claim 7, wherein said support flange projects radially from said guide body and includes a circular perimeter, and a distance between said outer surface and said circular perimeter of said flange is greater than a distance between said outer surface and a said circular perimeter of each said cooling fin, said support flange further including a surface contacting the cylinder head.

9. The valve guide of claim 1, wherein the guide consists essentially of aluminum bronze material.

10. The valve guide of claim 1, wherein said inner surface defining said void includes an annular recess adapted to receive an O-ring seal.

11. A valve assembly comprising:

a valve including a valve stem;

a valve guide comprising a guide body having an outer surface and an inner surface, said guide body comprising a first portion defining a first end of said valve guide and a second portion defining a second end of said valve guide, a void between said first end and said second end, said void defined by said inner surface and having a longitudinal axis, at least a portion of said valve stem disposed and slidingly movable in said void, a plurality of projections projecting radially from said outer surface of said first portion, and a support flange projecting radially from said guide body, said flange defining a boundary between said first portion and said second portion; and a coil spring having a base, said coil spring disposed about said first portion of said guide body, said base supported by said support flange.

12. The valve assembly of claim 11, further comprising:

an annular washer disposed on said support flange intermediate said support flange and said base of said coil spring, said base contacting said washer.

13. The valve assembly of claim 11, wherein:

said void has a circular cross-section; and said second portion has a length that is about 2 to about 3 times a diameter of said circular cross-section.

14. The valve assembly of claim 11, wherein each said projection is a cooling fin having an annular shape and a circular perimeter.

15. The valve assembly of claim 14, wherein a distance between said outer surface and said circular perimeter of a said cooling fin increases as a position of said cooling fin is closer to said support flange.

16. The valve assembly of claim 11, wherein the guide consists essentially of aluminum bronze material.

17. The valve assembly of claim 11, wherein:

said inner surface defining said void includes an annular recess; and the valve assembly further comprises an O-ring seal disposed within said annular recess and contacting said valve stem.

18. The valve assembly of claim 11, further comprising:

a retainer secured to said valve stem and including an annular lip, said retainer in contact with said coil spring, said coil spring retained about said valve stem and intermediate said annular lip and said support flange.

19. An apparatus comprising;

a cylinder head having a bore therein;

at least one valve, said valve including a valve stem; and at least one valve guide comprising a guide body having an outer surface and an inner surface, said guide body comprising a first portion defining a first end of said valve guide and a second portion defining a second end of said valve guide, said second portion disposed within said bore in said cylinder head, a void between said first end and said second end, said void defined by said inner surface and having a longitudinal axis, at least a portion of said valve stem disposed and slidingly movable in said void, a plurality of projections projecting radially from said outer surface of said first portion, and a support flange projecting radially from said guide body and including a surface, said support flange defining a boundary between said first portion and said second portion, said first surface contacting said cylinder head.

20. The apparatus of claim 19, wherein each said projection is a fin having an annular shape and a circular perimeter.

* * * * *